United States Patent [19]
Konstant et al.
[11] 4,317,523
[45] Mar. 2, 1982

[54] STORAGE STRUCTURE HAVING TWO-PIECE BEAMS

[75] Inventors: Anthony N. Konstant, Mount Prospect; John J. Weider, Arlington Heights, both of Ill.

[73] Assignee: Speedshelf International, Inc., Skokie, Ill.

[21] Appl. No.: 83,867

[22] Filed: Oct. 12, 1979

[51] Int. Cl.[3] ..... A47F 5/00
[52] U.S. Cl. ..... 211/187; 108/107; 211/182
[58] Field of Search ..... 211/187, 191, 190, 208, 211/183, 182; 108/107, 111

[56] References Cited

U.S. PATENT DOCUMENTS 2,508,032 5/1950 Kennedy ..... 211/182 UX
4,261,470 4/1981 Dolan ..... 211/191

FOREIGN PATENT DOCUMENTS 729006 3/1966 Canada ..... 211/187
1227316 8/1960 France ..... 211/187
918558 2/1963 United Kingdom ..... 211/182

*Primary Examiner*—Roy D. Frazier
*Assistant Examiner*—Robert W. Gibson, Jr.
*Attorney, Agent, or Firm*—Fitch, Even, Tabin, Flannery & Welsh

[57] ABSTRACT

A storage structure includes at least four posts which provide the vertical framework for a rack arrangement. The posts are interconnected in pairs to form end frames and have vertical rows of slots in opposite surfaces. Longitudinally extending channels are connected to the posts by hooks having lower camming edges. After the hooks are received in the slots in the posts, the channels move downward to tighten the connection. The channels are used in matching pairs, and upwardly extending tabs are formed in the lower flange of the outer channel whereas the upper flange is formed with pockets or slots. The inner channel includes downwardly extending tabs in its upper flange, which are received in the slots or pockets of the outer channel, and similar pockets or slots in its lower flange which receive the upwardly extending tabs.

13 Claims, 13 Drawing Figures

11
33
31
29
35
17
19
23
15
21
25
13

13
17
27
15
21
37
29
53
33
57
31
35
19

STORAGE STRUCTURE HAVING TWO-PIECE BEAMS

This invention relates to storage installations and more particularly to lightweight storage rack structures designed to span a substantial distance between uprights.

A number of concepts have been developed for different types of metal shelving which do not require nuts and bolts for assembly. Some of these concepts have been patterned after developments in the field of adjustable storage racks which, in the past fifteen years, have become highly sophisticated in their design to accommodate storage of almost any type of merchandise. One particularly efficient design for metal shelving is illustrated in U.S. patent application Ser. No. 831,524, filed Sept. 8, 1977, now U.S. Pat. No. 4,173,934 and uses posts having spaced pairs of parallel vertical slots which allow for the completely boltless assembly of horizontal supports that, in turn, include flanges or lips to support individual metal shelves.

The present invention provides an improved beam arrangement which allows a metal shelving design of this general type to be expanded to substantially larger dimensions because of its capability to effectively span a fairly long distance between vertical uprights while supporting the loadbearing decks or shelves. Thus, the invention provides vertical framework suitable to fill the gap between generally lightweight storage, which is available in the field of metal shelving, and the fairly heavy-weight storage rack installations which are readily available in the form of adjustable pallet racks and the like.

More specific objectives of the invention will be apparent from the following detailed description of preferred embodiments of rack structures, when read in conjunction with the accompanying drawings wherein.

Figure 1:
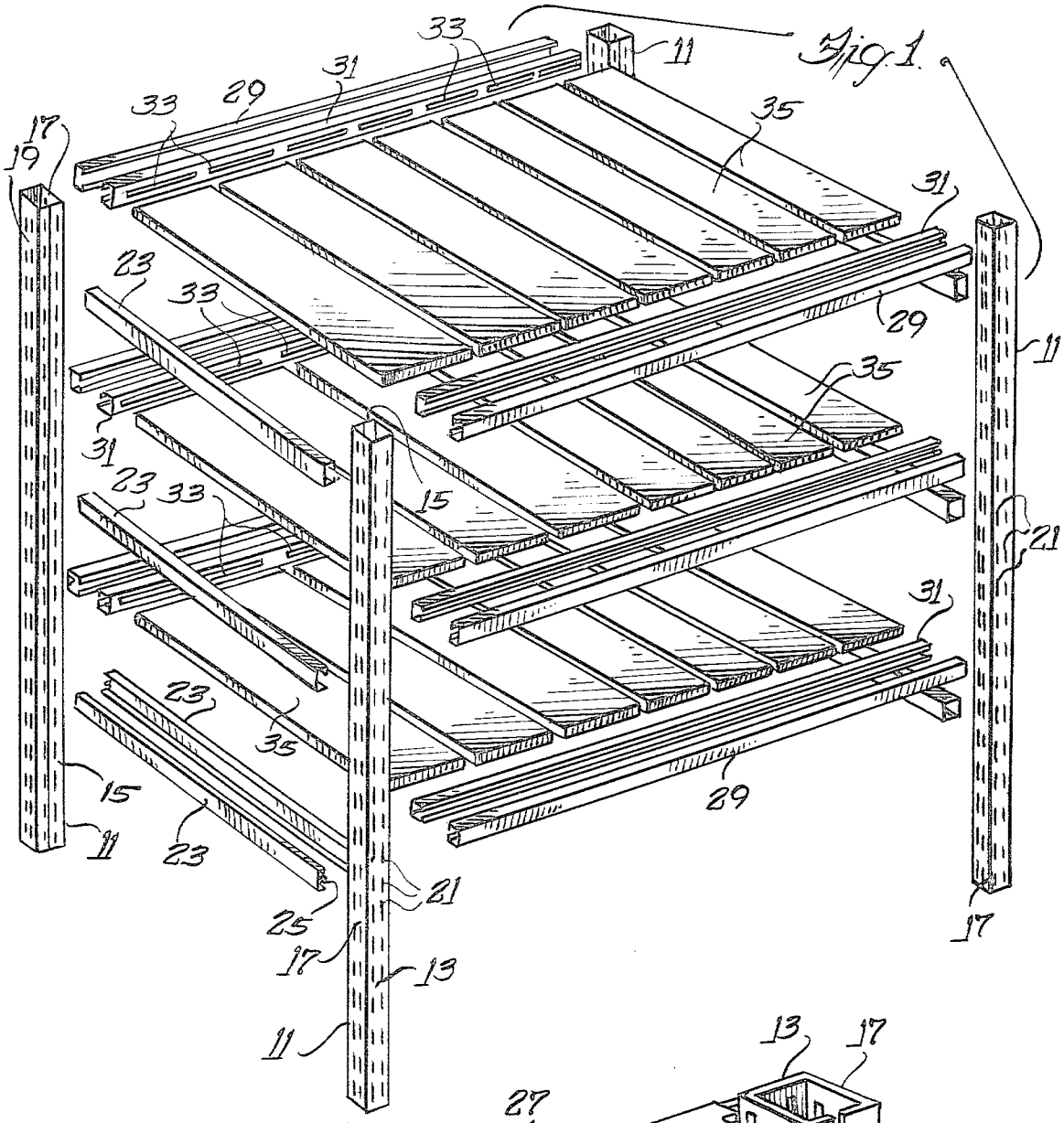
FIG. 1 is an exploded perspective view of a structure including the improved supporting beams.

As illustrated in FIG. 1, the invention provides a vertical framework employing at least four vertical columns or posts 11 which are of rectangular cross-section, preferably square, and provide four faces at right angles to one another. The faces are hereinafter referred to as a front or outward face 13, a rear or inward face 15 and a pair of side faces 17,19. All of the faces are provided with a series of spaced vertical slots 21 in two parallel rows with the slots being aligned between rows to provide horizontal pairs at predetermined spaced vertical intervals. The posts 11 are fabricated from prepunched strips of steel which are then rolled to the tubular configuration. The two edges of the rolled square tube preferably are located in the center of the rear face 15, and these edges can be welded for additional strength or simply left open, depending somewhat on the gauge or thickness of the steel which is used.

Pairs of the posts 11 are preferably first interconnected by horizontal braces 23 which extend between the respective rear faces 15 of the posts and which carry lugs 25 which are received in the slots on the respective side faces 17,19 of the posts. The illustrated horizontal brace 23 is in the form of a shallow channel, the web of which is vertical. Each of the horizontal braces 23 contains a pair of lugs at each end which are vertically spaced apart a distance equal to the spacing between the slots 21 of the post 11, and the lugs 13 project at right angles to the plane of the brace.

A suitable number of horizontal braces 23 are used to interconnect the two adjacent posts to form an end frame which defines the lateral boundary of a storage section. In the illustrated embodiment, as shown in FIG. 1, most of the horizontal braces are shown as being disposed for attachment to the outward side faces of the posts 11. However, one or more of the braces 23 is preferably attached to the inward side faces of the pair of posts 11 at a location where it will not interfere with the attachment of the longitudinal beam 27 because such attachment to both side faces results in increased overall rigidity of the end frame. A pair of braces 23 are illustrated at the lowermost location or each end frame.

Although the vertical framework illustrated in FIG. 1 shows only a single storage section, it should be understood that the framework can be extended to create an array of any size desired by simply adding two more posts and an appropriate number of beams using the other rows of slots in each of the front and rear faces 13,15 of the posts. In such an instance where the storage array is so extended, all of the horizontal braces 23 are connected to the posts 11 at vertically intermediate locations where they will not block access to the slots that are to be used to connect the beams 27.

The beams 27 extend longitudinally between the posts 11 of different end frames, and each beam 27 is made up of a pair of channel-like members 29,31 which interfit together. The vertical web of the outer member 29 of each beam is flat and imperforate, whereas the vertical web of each inner member 31 is punched to provide a series of upward extending lips or supports 33 which engage the underside of deck panels 35. Thus, the beams 27 provide the sole support for a plurality of deck panels 35 (seven of which are illustrated at each level) which provide a substantially unbroken supporting surface at each desired horizontal level, extending from beam to beam in a direction perpendicular thereto.

Figure 2:
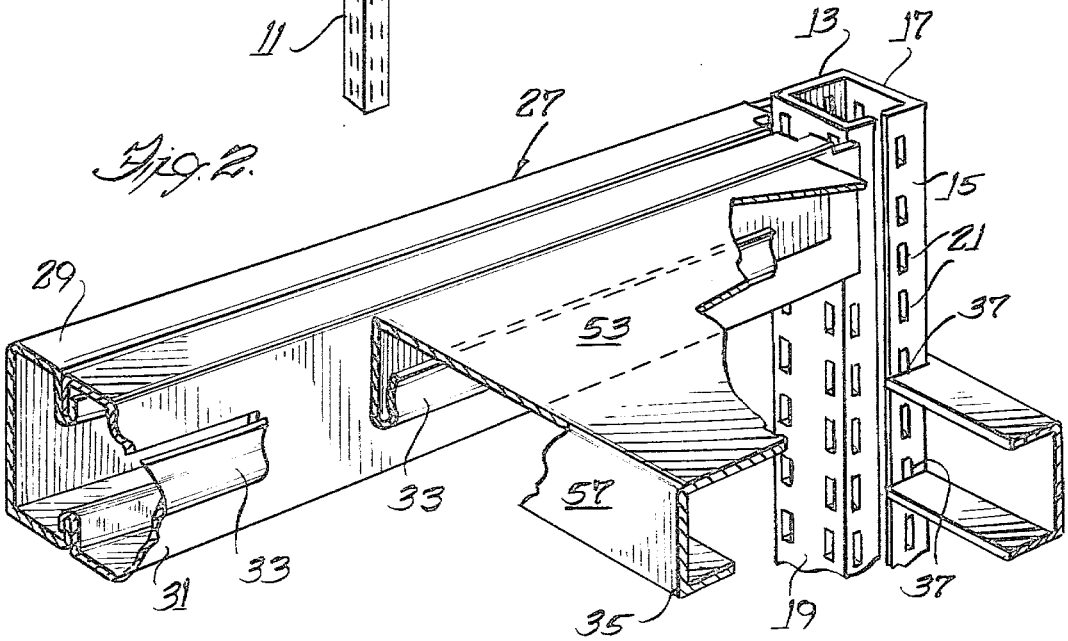
FIG. 2 is an enlarged, fragmentary, assembled view emphasizing the construction and interconnection of the improved beam shown in FIG. 1.
Figure 3:
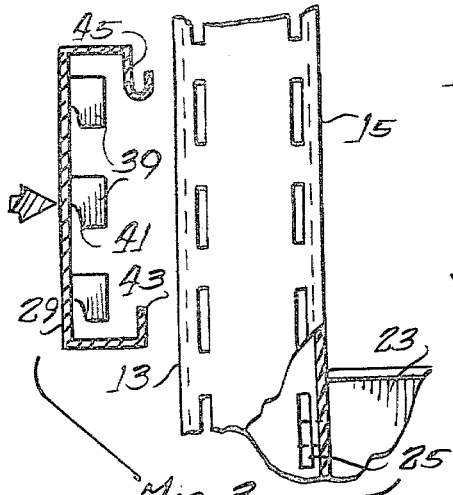
FIGS. 3 through 6 are fragmentary side sectional views illustrating the sequence of attachment of the improved beam to the post to achieve the structure illustrated in FIG. 2.

As best seen in FIGS. 2 and 3, the horizontal brace 23 locks onto the post 11 by means of lugs 25 which extend perpendicular to the plane of the brace. The distance between the lugs 25 and the adjacent upper and lower shoulders 37 of the brace 23 is held to close tolerance so that, when the lugs are pressed into place, there is a tight fit between the adjacent shoulders and the surface of the rear face 15 of the post which is engaged. Each mounting lug 25 is of generally hook-like shape having a lower inward slanted edge that engages the bottom edge of the slot 21 and cams the extended portion of the web of the horizontal brace 23 tightly against the vertical side face 17 of the post 11.

As earlier indicated, each of the beams 27 is made up of a pair of longitudinally extending outer and inner members or halves 29,31 which interfit with each other to provide an extremely rigid connection with the posts as a result of a composite clamping action and which accordingly provide not only excellent beam strength in a load-supporting capacity, but also contributes substantially to the overall stability of the vertical framework. The beam outer and inner members 29,31 have three spaced-apart lugs 39 at each end, which lugs are disposed at about right angles to the vertical web of the beam and are proportioned and spaced-apart similar to the lugs 25 on the horizontal braces so as to similarly interfit through the vertical slots 21 in the front and rear faces of the posts 11. The lugs 39 are preferably formed with similar lower camming edges 41 to draw the respective beam half into a tight fit with the respective front or rear face of the post 11.

Figure 5:
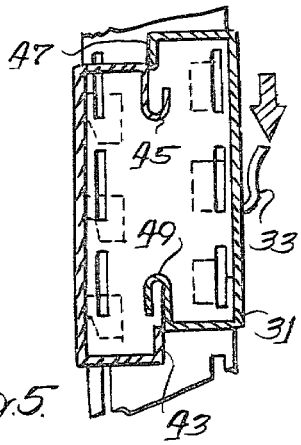

As earlier indicated, the beam halves 29,31 are formed to interfit with each other at upper and lower locations generally along the centerline of the composite beam 27. The outer longitudinal member 29 has a generally channel-like cross-section and has its lower flange bent upward to form an upwardly extending subflange 43 that preferably extends for substantially the entire length of the beam. Similarly, the upper flange of the outer member 29 is bent downward and then rolled back upon itself to form an upwardly open pocket 45 which likewise extends for substantially the length of the beam. In order to complement the outer member 29, the inner member 31 has its top flange bent downward to form a downwardly extending subflange 47, and the bottom flange of the inner member 31 is bent upward and then rolled upon itself to form a downward extending pocket 49 to receive the upper edge of the outer member subflange. In addition, the vertical web of the inner member 31 is punched to provide the series of lips 33 which, as best seen in FIG. 5, have the cross-section of a generally shallow "S".

The preferable assembly procedure is sequentially illustrated in FIGS. 3 through 6. After the end frames have been constructed by connecting the posts 11 in pairs by the horizontal braces 23, an outer beam half 29 is moved horizontally inward toward the front face 13 of one of the posts as indicated by the arrow in FIG. 3, so that the three lugs 39 enter the three uppermost slots in the adjacent row of the post 11. After the outer member 29 has been fully inserted, the downward movement, as depicted by the arrow in FIG. 4, causes the camming surfaces 41 of the lugs 25 to engage the bottom edges of the slots 21 and assure a tight fit at the contacting surfaces. The other end of the outer half of the beam is similarly connected to a post 11 of a second end frame.

Figure 4:
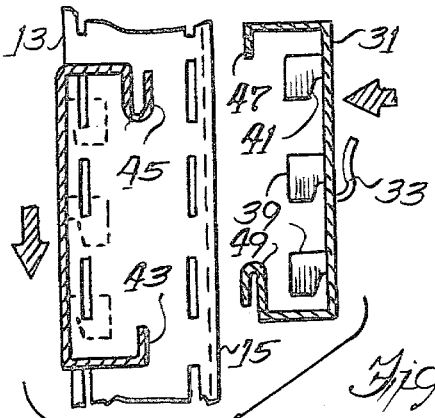

Next, the inner beam half 31 is moved horizontally so that its lugs 39 enter the corresponding three uppermost slots on the rear face 15 of the post as illustrated in FIG. 4. When fully inserted, the upper subflange 47 is directly above the upwardly open pocket 45 of the outer beam half, and the downwardly open pocket 49 is poised directly above the upwardly extending subflange 43 of the outer beam half. Downward movement of the inner beam half 31, as depicted by the arrow in FIG. 5, causes the two subflanges 43,47 to be respectively received and engaged within the corresponding pockets 45,49 and causes the camming surfaces 41 of the lugs 39 to pull the extended web portions of the inner beam half tightly against the rear surface 15 of the post.

The pockets 45,49 are proportioned so that there is a tight frictional fit with the respective subflanges 43,47, and this clamping action not only rigidifies the overall connection between beam 27 and post 11, but it positively prevents the beam 27 from becoming inadvertently disconnected because disengagement cannot be carried out without specifically reversing the sequence of steps just described. In other words, even if the composite beam 27 were displayed upward by a jolt or some inadvertent upward contact, accidental disengagement would not occur because it is necessary to first break the two connections between both subflanges 43,47 and the respective pockets 45,49 that tightly engage each other along substantially the entire length of the beam 27. These two connections can only be broken by positively holding the outer beam half 29 down while the inner beam half 31 is raised.

Figure 9:
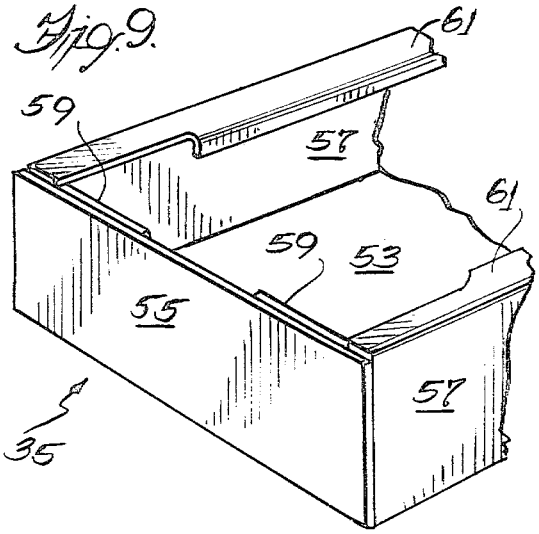
FIG. 9 is a fragmentary perspective view showing one of the deck or shelf sections which is incorporated as a part of the structure.
Figure 10:
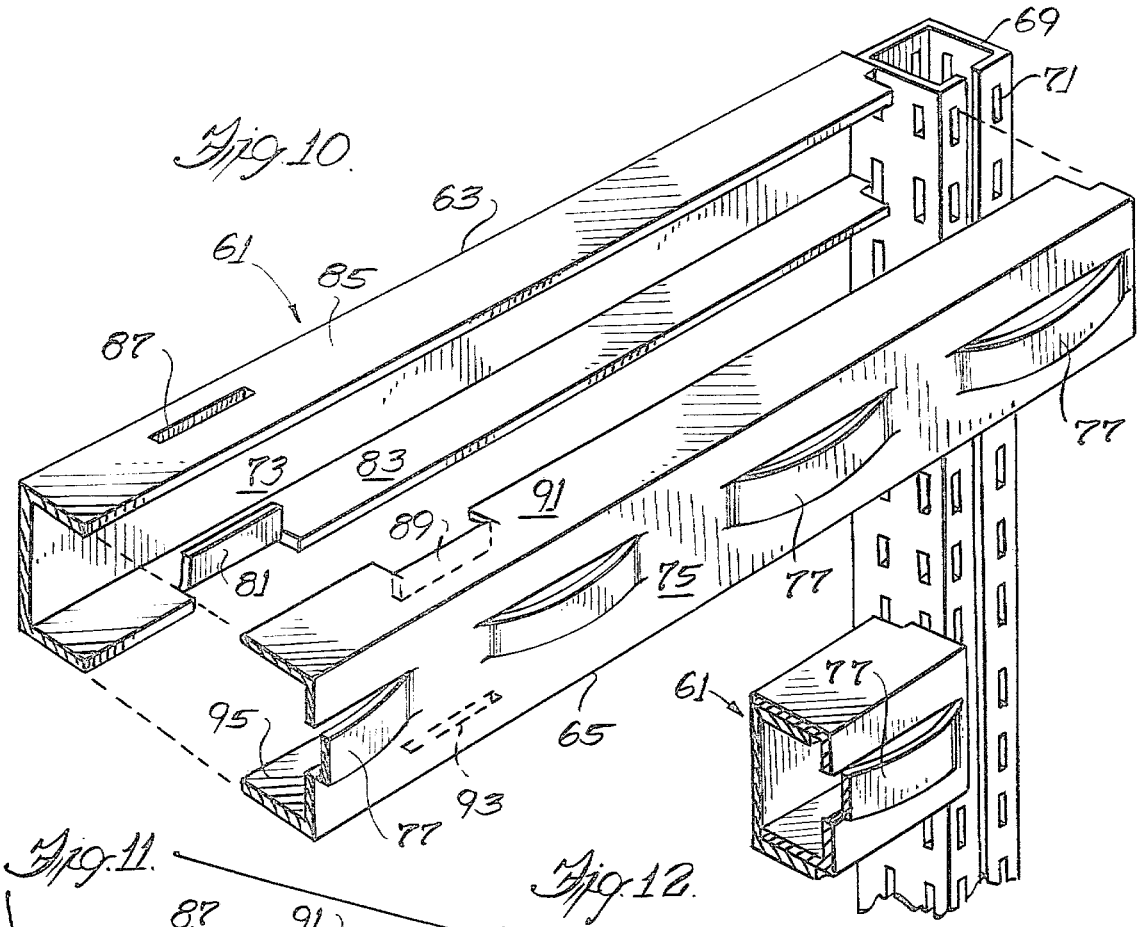
FIG. 10 is an exploded perspective view showing an alternative embodiment of the improved beams.

After the composite beam 27 are installed at the same vertical locations on the post at the opposite sides of the end frame, deck panels 35 are installed to complete the rack structure assembly. One deck panel 35 is shown in inverted perspective in FIG. 9 and is preferably formed from sheet metal which is appropriately punched to provide a main rectangular panel 53, plus depending front and rear panels 55 and side panels 57. In the illustrated embodiment, the side panels are formed with extensions 59 which are bent at 90° and which back-up the front and rear panels 55 to which they may be tack-welded. The lower edges of the side panels 57 can also be folded over to provide inwardly extending subflanges 61 and increase the strength and rigidity of the overall deck panel 35. The front and rear panels 55 are simply bent at 90° to the main panel to complete the skirt-like arrangement.

Figure 6:
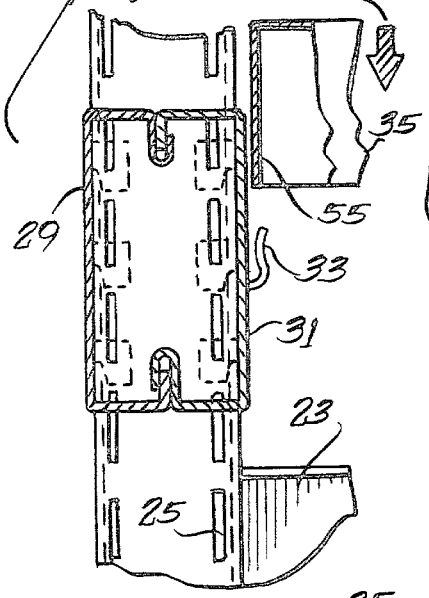
Figure 7:
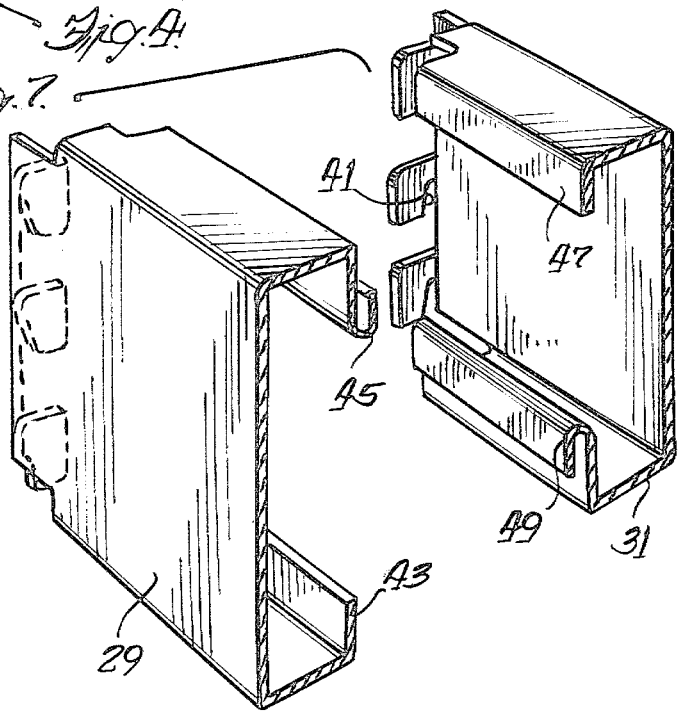
FIG. 7 is an enlarged fragmentary perspective view showing the two complementary members which make up the improved beam.
Figure 8:
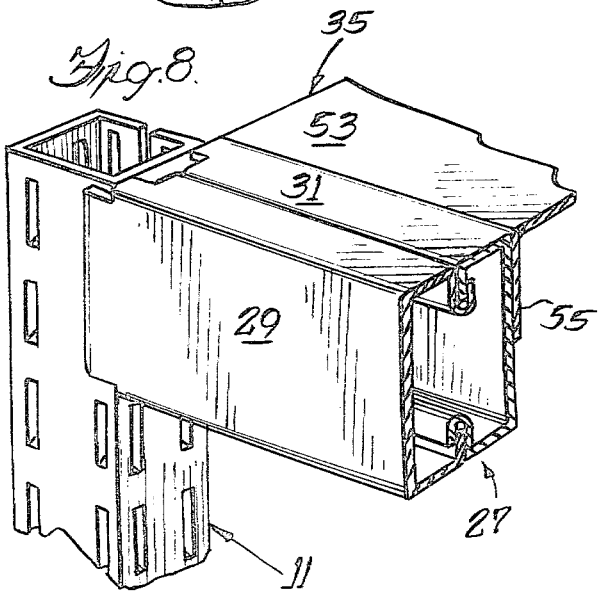
FIG. 8 is a fragmentary perspective view showing the beam of FIG. 7 attached to the post.

As shown in FIG. 6, the deck panels 35 are installed by pressing them downward so that their front and rear panels 55 are received by the punched out lips 33 provided on the webs of the inner beam members 31. With all of the deck members installed, the storage section is complete and ready for use.

As earlier indicated, all of the pieces of the framework and the deck panels can be formed from sheet metal. The posts 11 may be punched, rolled and welded using, for example, 14 or 16 gauge galvanized or painted steel. The beam halves 29,31 are preferably punched and rolled from similar material depending somewhat upon the length of their span and the load which they are intended to support in a particular installation. Inasmuch as the horizontal braces 23 are not load-bearing to the same extent, they may be made of a lighter material, for example 16 or 18 gauge steel. The thickness of the deck panels will also be dependent upon the weight of the loads to be supported; however, 20 or 22 gauge steel will generally be employed.

Depicted in FIGS. 10 through 13 is an alternative embodiment of a beam 61 which can be used instead of the beams 27 without making any changes to the vertical posts or the horizontal braces. The beam 61 is made up of a pair of longitudinal channel-like members 63,65 which interfit together. The channel members carry lugs or hooks 67 for attaching the beam to a post 69. The post has a pattern of slots 71, the same as previously described, and the lugs 67 are received by the slots 71 in the same manner as in the embodiment shown in FIGS.1 through 9.

Figure 13:
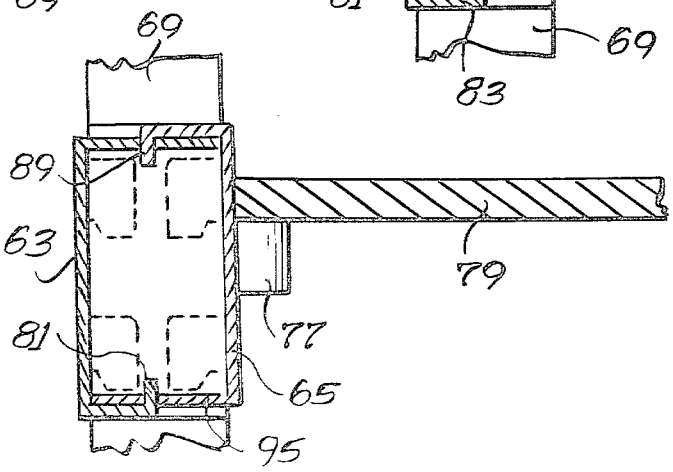

The vertical web 73 of the outer longitudinal member 63 is flat and imperforate; however, the vertical web 75 of the inner member 65 is punched to provide a series of outwardly extending half-loops 77 which, as shown in FIG. 13, support a rigid deck or shelf 79. A metal-formed shelf 35 can be used; however, simple wood planks or decking is conveniently employed.

The outer longitudinal member 63 has at least one upstanding tab 81 formed in its lower flange 83. The upper flange 85 has a slot 87 formed therein. The inner longitudinal member 65, which is complementary to the outer member 63, has a tab 89 formed in its upper flange 91 and a slot 93 formed in its lower flange 95. For a beam 61 up to about four feet in length, it is considered satisfactory to provide a single tab 81,89 in each of the channel members, which is located generally equidistant from both ends. For a beam about seven feet in length, a pair of tabs 81,89 are usually provided in each channel member, and when the length of the beam 61 reaches about nine feet, three tabs (spaced equidistant from one another and the ends) are generally employed in each longitudinal member. The tabs 81,89 are proportioned so as to be respectively received in the slots 93,87, and the slots are appropriately located to receive the tabs.

Figure 11:
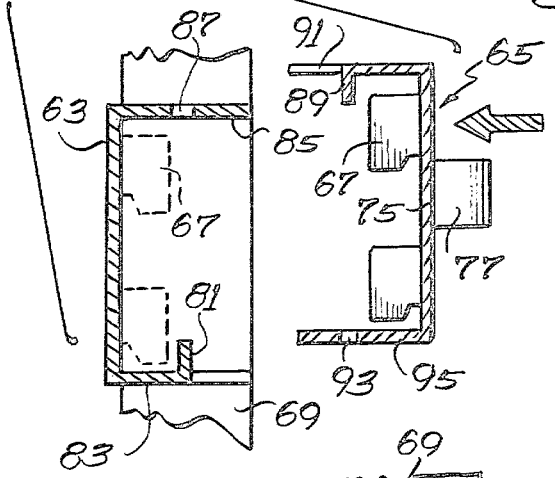
FIGS. 11 through 13 are fragmentary sectional views similar to FIGS. 11-13.
Figure 12:
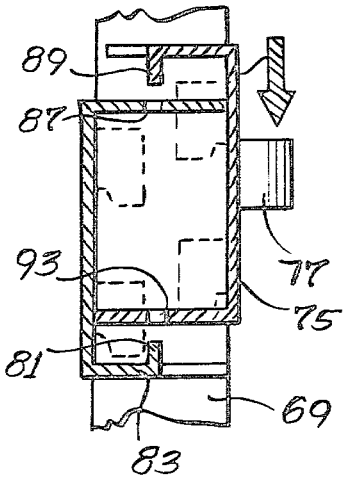

In installing the beam 61 on a post 69 as a part of creating or erecting the rack framework, the outer longitudinal member 63 is first connected to posts at each end by inserting the lugs 67 through the appropriate pair of slots in each post 69, as shown in FIG. 11. The inner longitudinal member 65 is then brought into position from the interior as depicted by the arrow in FIG. 11. After the lugs 67 on the inner member 65 have been fully inserted through the slots 71 so that the interior surface of the vertical web 75 is in contact with the inward face of the post 69 (which arrangement is depicted in FIG. 12), downward movement thereafter creates the locking effect. As can be seen in FIG. 13, the downward extending tab 89 carried by the upper flange 91 of the interior member 65 enters the slot 87 in the upper flange 85 of the outer channel member, and the slot 93 in the lower flange 95 of the inner channel member 65 simultaneously passes downward over and receives the upstanding tab 81 on the lower flange 83 of the outer member. The installed and locked beam 61 is depicted in FIG. 13, with a deck panel 79 extending thereacross and being received on supports 77 provided on a similarly situated beam on the opposite two posts.

Although the invention has been described with regard to certain preferred embodiments, it should be understood that changes and modifications as would be obvious to one having the ordinary skill in this art may be made without departing from the scope of the invention which is defined solely by claims appended thereto. Various features of the invention are set forth in the claims which follow.

What is claimed is:

1. A beam for use in a rack framework to interconnect two vertical posts, which posts are provided with means in opposite surfaces thereof for engagement with said beam, said beam comprising first and second longitudinally extending channel members each having a vertical web and horizontal upper and lower flanges at least a portion of the lower flange of said first longitudinal member being bent upward to create upwardly extending tab means and the lower flange of said second longitudinal member being formed with means proportioned to receive said tab means, at least a portion of the upper flange of said second longitudinal member being bent downward to create downwardly extending tab means and the upper flange of said first longitudinal member being formed with means proportioned to receive said downwardly extending tab means, said longitudinal members being provided with connecting means near their ends to interengage with the engagement means on said posts and support said members with said flanges extending toward each other.

2. A beam in accordance with claim 1 wherein said tab means extends for a major distance along the length of said first longitudinal member and wherein said second longitudinal is formed with downwardly open pocket means for receiving said tab means.

3. A beam in accordance with claim 1 wherein said downwardly extending tab means extends for a major distance along the length of said second longitudinal member and wherein said first longitudinal member is formed with upwardly open pocket means for receiving said downwardly extending tab means.

4. A beam in accordance with claim 2 wherein said tab means extends for substantially the entire length of said longitudinal.

5. A beam in accordance with claim 2 wherein said pockets are formed so as to frictionally engage said tab means.

6. A beam in accordance with claim 1 wherein said upper flange of said first longitudinal member and said lower flange of said second longitudinal member contain slots which are proportioned to receive said tab means.

7. A beam in accordance with claim 1 wherein the posts are provided with apertures and said connecting means comprise lugs which fit into said apertures.

8. A beam in accordance with claim 7 wherein said aperture are vertical slots and wherein said lugs are hooks proportioned to fit over and engage the bottom edges of said apertures.

9. A beam in accordance with claim 8 wherein said hooks have lower camming edges which move said vertical web into tight contact with said post upon engagement with said bottom edge of said aperture.

10. A beam in accordance with claim 1 wherein the vertical webs of said second longitudinal members are punched to form supports for deck panels that extend transverse to said beam.

11. A storage structure which comprises four vertical posts, which posts are provided with slots in opposite surfaces thereof, means interconnecting said posts in pairs to form end frames, and a plurality of beams extending between and connecting posts of opposite end frames, each of said beams including first and second longitudinally extending channel members, said channel members each having a vertical web and horizontal upper and lower flanges and being disposed with said flanges extending toward each other, said channel members being provided near their ends with hook means proportioned to be received in said slot means in said posts, said hook means permitting downward movement of said channel members after said hook means is received in said slot means, the lower flanges of said first and second longitudinals and the upper flanges of said first and second longitudinals being respectively formed with interengaging means to join said channel members into a composite beam, which interengaging means becomes engaged as a result of said downward movement of said second longitudinal.

12. A storage structure in accordance with claim 11 wherein the lower flange of said first channel member terminates in an upwardly extending subflange along a major portion of the length thereof and the upper flange in an upwardly open pocket and wherein the lower flange of said second channel member terminates in a downwardly open pocket and the upper flange in a downward-extending subflange along a major portion of the length thereof.

13. A storage structure in accordance with claim 11 wherein the lower flange of said first channel member includes upwardly extending tab means and the upper flange includes slot means and wherein the lower flange of said second channel member includes slot means and the upper flange includes downwardly extending tab means.

* * * * *